US005319917A

United States Patent [19]

Bothner et al.

[11] Patent Number: 5,319,917

[45] Date of Patent: Jun. 14, 1994

[54] RESERVE-SURFACE CLEANER AND VACUUM FOR RING-SPINNING MACHINE

[75] Inventors: Jakob Bothner, Göppingen-Jebenhausen, Fed. Rep. of Germany; Daniel Friedrich, Marmoutier, France; Thomas Peter, Esslingen, Fed. Rep. of Germany; Rainer Maier, Weilheim, Fed. Rep. of Germany; Rainer Kurz, Salach, Fed. Rep. of Germany; Bernd Paulisch, Eislingen, Fed. Rep. of Germany

[73] Assignee: Zinser Textilmaschinen GmbH, Ebersbach/Fils, Fed. Rep. of Germany

[21] Appl. No.: 985,677

[22] Filed: Dec. 4, 1992

[30] Foreign Application Priority Data

Dec. 5, 1991 [DE] Fed. Rep. of Germany ..... 4140049

[51] Int. Cl.[5] ..... D01H 11/00

[52] U.S. Cl. ..... 57/304; 15/312.2

[58] Field of Search ..... 57/300, 303, 304, , 57/305, 306; 28/294; 15/301, 312.2

[56] References Cited

U.S. PATENT DOCUMENTS

| | | | |
|---|---|---|---|
| 876,960 | 1/1908 | Harrington et al. | 57/300 |
| 3,312,051 | 4/1967 | Schumann et al. | 57/304 |
| 4,133,168 | 1/1979 | Keller et al. . | |
| 4,517,794 | 5/1985 | Sakai et al. | 57/300 X |
| 4,936,086 | 6/1990 | Carter et al. . | |
| 5,177,950 | 1/1993 | Fowler, Jr. et al. | 57/304 |

FOREIGN PATENT DOCUMENTS

| | | | |
|---|---|---|---|
| 0251397 | 1/1988 | European Pat. Off. . | |
| 3213755 | 2/1982 | Fed. Rep. of Germany . | |
| 3337119 | 4/1984 | Fed. Rep. of Germany . | |
| 3839686 | 5/1990 | Fed. Rep. of Germany . | |
| 4021742 | 1/1992 | Fed. Rep. of Germany . | |
| 1453640 | 9/1966 | France . | |
| 180620 | 10/1983 | Japan | 57/300 |
| 100724 | 6/1984 | Japan | 57/300 |
| 61-83332 | 4/1986 | Japan . | |

OTHER PUBLICATIONS

Patent Abstract of Japan; vol. 010, No. 258, Sep. 4, 1986; "Device for cutting and removing yarns remaining around spindle in spinning . . . ".

*Primary Examiner*—Joseph J. Hail, III

*Attorney, Agent, or Firm*—Herbert Dubno; Andrew Wilford

[57] ABSTRACT

A reserve-surface cleaning apparatus is used in combination with a ring-spinning machine having a longitudinally extending row of spindles each adapted to hold a roving sleeve and each formed below the respective sleeve with a respective reserve winding area and a longitudinally extending frame extending along a back side of the row and a service area extending along a front side of the row. The cleaning system has a guide rail extending on the frame longitudinally along the back side of the row of spindles, a cleaner carriage displaceable longitudinally along the rail past the spindles, and a drive for displacing the cleaner carriage longitudinally along the rail past the spindles. A set of tools on the cleaner carriage strips roving from the reserve surfaces as the cleaner carriage passes same. A vacuum carriage displaceable longitudinally along the frame has an attachment with an end projecting from the front side back toward the stations level with the reserve surfaces for aspirating roving stripped therefrom by the tools and a drive engaged between the vacuum carriage and the frame displaces the vacuum carriage longitudinally along the frame and thereby sequentially positions the attachment immediately adjacent the surfaces. A synchronizing unit connected between both of the drives synchronously jointly moves the carriages and maintains the attachment transversely aligned with the tools.

17 Claims, 5 Drawing Sheets

RESERVE-SURFACE CLEANER AND VACUUM FOR RING-SPINNING MACHINE

FIELD OF THE INVENTION

The present invention relates to a ring-spinning machine. More particularly this invention concerns a system for cleaning the reserve surfaces of the spindles of such a machine and for vacuuming up roving particles and lint at such a machine.

BACKGROUND OF THE INVENTION

A standard ring-spinning or -twisting machine has a spindle bank on which a plurality of upright spindles arranged in a row are rotatable. These spindles normally carry sleeves on which respective rovings are wound to form the desired yarn packages. The yarns or rovings run over ring guides or the like to the respective spindles.

Once a package is complete, the respective guide drops down to a level below the sleeve and winds several turns of the roving around a lower reserve surface on the respective spindle. When the sleeve is subsequently doffed, the roving breaks, leaving the leading end of the incoming roving wound around the lower reserve surface of the spindle. Then a new spindle is set in place and the winding operation starts again with the roving caught on the lower reserve surface being caught on the new sleeve and wound up, repeating the cycle.

Clearly a problem with this system is that the reserve surface quickly gets fouled with the roving, since several turns are added each time the sleeve is changed. These reserve surfaces must be cleared periodically.

Accordingly machines have been proposed in European patent application 251,397 filed based on an Italian priority of Jun. 29, 1988 by S. Sartoni et al and U.S. Pat. No. 4,133,168 of Kellet that have a carriage that moves past the spindles and that carries equipment for clearing the reserve surfaces. This equipment includes a motorized scraper and a vacuum arrangement. In general such a system is quite complex and adds considerably to the cost of the apparatus.

Another system is described in Japanese patent 61-83332 which has a traveling vacuum machine that can move along the row of spindles to vacuum up roving fragments and lint from the service areas to each side of the machine. Like the other two above-described cleaning apparatuses, this system has the disadvantage that it gets in the way of the standard doffing and donning equipment. Its lower guide rail lies on the front or outside of the row of spindles, just where the doffing/-donning equipment must work.

In copending and commonly owned patent application Ser. No. 07/962,142 filed Oct. 16, 1992 an apparatus for clearing roving wound on the reserve surfaces has a guide rail extending longitudinally along a back side of the beam adjacent the spindles, a carriage displaceable along the rail past the spindles, and a drive including a longitudinally extending drive element secured to the carriage for displacing same longitudinally along the rail past the spindles. A roving-cutting element is fixed on the carriage engageable immediately adjacent the spindles between the respective lower reserve surfaces and sleeves and a roving-clearing element is fixed on the carriage below the cutting element and engageable immediately adjacent the lower reserve surfaces of the spindles. This device does not clear the service area of the stripped-off roving.

OBJECTS OF THE INVENTION

It is therefore an object of the present invention to provide an improved cleaning apparatus for a spinning machine.

Another object is the provision of such an improved cleaning apparatus for a spinning machine which overcomes the above-given disadvantages, that is which accurately strips off and cleans up any roving on the reserve surfaces, and that does not get in the way of the machine operators or equipment servicing the machine.

SUMMARY OF THE INVENTION

The instant invention is a reserve-surface cleaning apparatus used in combination with a ring-spinning machine having a longitudinally extending row of spindles each adapted to hold a roving sleeve and each formed below the respective sleeve with a respective reserve winding area and a longitudinally extending frame extending along a back side of the row and a service area extending along a front side of the row. A reserve-surface cleaning system has according to the invention a guide rail extending on the frame longitudinally along the back side of the row of spindles, a cleaner carriage displaceable longitudinally along the rail past the spindles, and a drive for displacing the cleaner carriage longitudinally along the rail past the spindles. A set of tools on the cleaner carriage strips roving from the reserve surfaces as the cleaner carriage passes same. A vacuum carriage displaceable longitudinally along the frame has an attachment with an end projecting from the front side back toward the stations level with the reserve surfaces for aspirating roving stripped therefrom by the tools and a drive engaged between the vacuum carriage and the frame displaces the vacuum carriage longitudinally along the frame and thereby sequentially positions the attachment immediately adjacent the surfaces. A synchronizing unit connected between both of the drives synchronously jointly moves the carriages and maintains the attachment transversely aligned with the tools.

According to the invention the synchronizing unit is a mechanical coupling between the two drives. The drives include at least one longitudinally extending, flexible but substantially inextensible drive element secured to the carriages and at least one releasable coupling engaged between the drive element and one of the carriages. Each carriage is fixed to a respective straight stretch of the drive element or elements, the stretches running longitudinally parallel to each other. The coupling is on the vacuum carriage and is electromagnetically operable.

For simplest operation a single such drive element is connected to both carriages although it is within the scope of the invention when respective independent such drive elements are connected to the carriages, in particular when the spinning machine is two-sided with two rows of spindles and two service areas transversely flanking the machine. Normally the element or elements are formed as cables and the drives each include at least one sheave having a part-circular-section groove.

It is also within the scope of the invention for each drive to include a respective electric drive motor. The synchronizer including an electronic synchronizing circuit connected between the motors. Both of the motors operate on discontinuous—normally alternating-current—voltage and the synchronizing unit includes at least one discontinuous-voltage generator connected to both motors. Furthermore the carriage and vacuum drives include respective carriage and vacuum drive motors connected to the respective carriages. The synchronizer includes respective vacuum and cleaner sensors for generating outputs corresponding to the longitudinal positions of the respective carriages and a controller connected to the motors and to the sensors for operating the motors to position the tools transversely in line with the attachment.

BRIEF DESCRIPTION OF THE DRAWING

The above and other objects, features, and advantages will become more readily apparent from the following, reference being made to the accompanying drawing in which.

SPECIFIC DESCRIPTION

Figure 3:
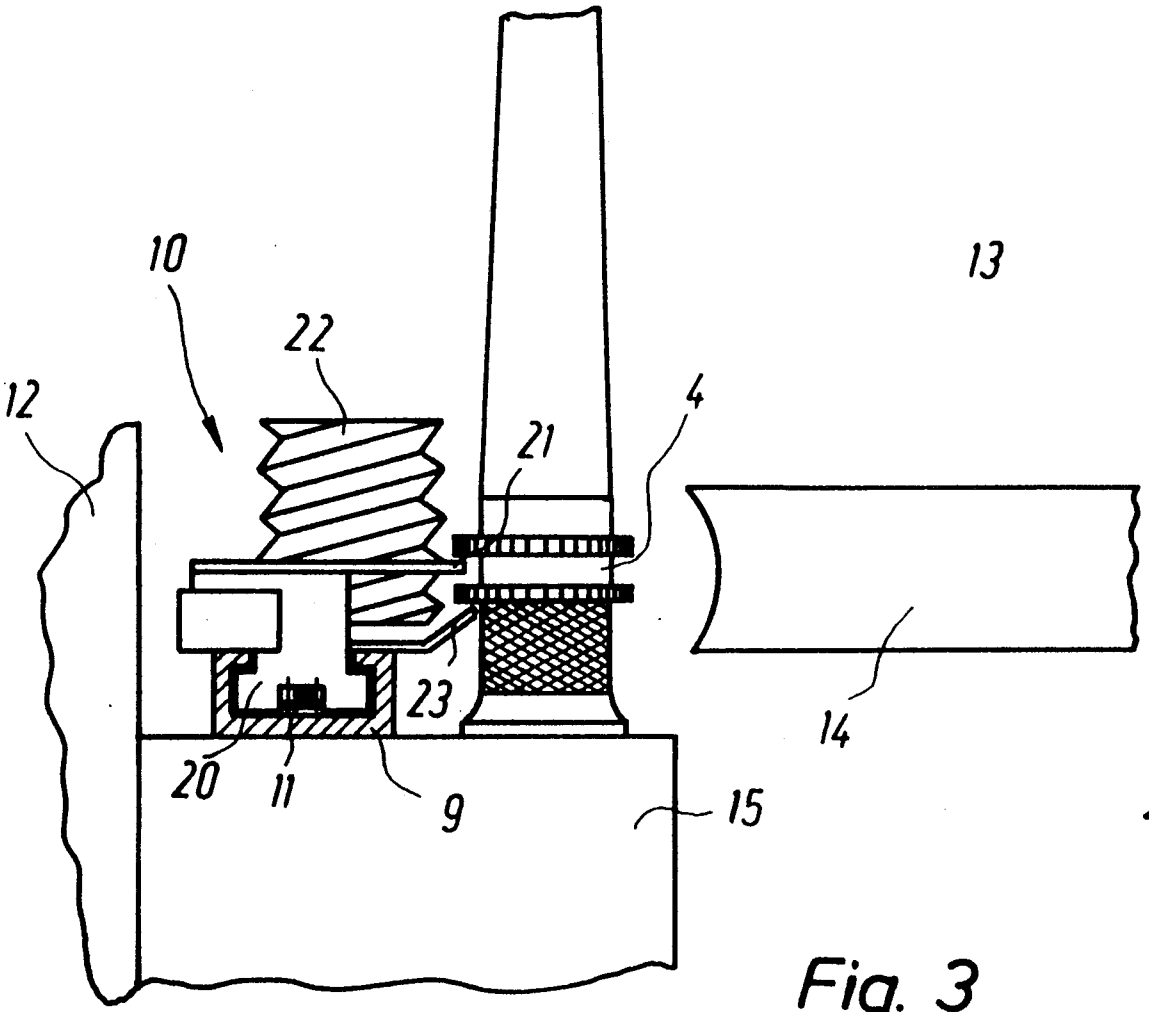
FIG. 3 is a large-scale view of the detail indicated at III in FIG. 2.
Figure 4:
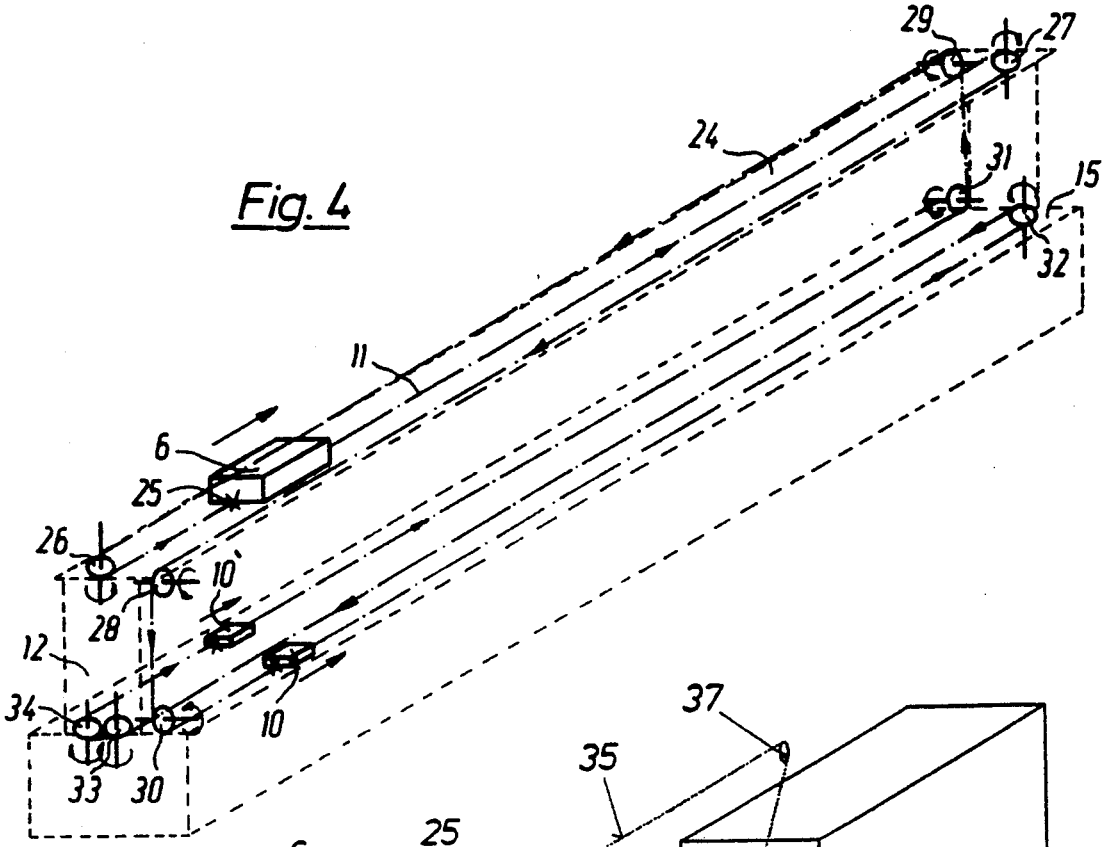
FIG. 4 is a mainly schematic diagram illustrating the drive element of the FIG. 1 system.

As seen in FIGS. 1, 2, 3, 4, and 7 a ring-spinning apparatus 1 according to the invention has a frame comprised of two end stanchions 2 and 3 spaced apart longitudinally by a distance L and having lower frame elements 12 and 15 and an upper frame element or rail 24 extending longitudinally between them. The machine has two rows 4 of spindles 4' each normally holding a respective roving sleeve and each formed as shown in FIG. 3 with a reserve surface 4''. Service areas 13 flank the machine 1 along the front sides of the rows 4.

A lower rail 9 extends longitudinally along the frame element 15 adjacent each spindle row 4 and supports a respective cleaner 10 or 10' each having as seen in FIG. 3 a cleaner carriage 20 provided with tools 21, 22, and 23 for stripping roving from and breaking loops of roving off the reserve surfaces 4'' in the manner described in the above-cited copending U.S. patent application.

The upper rail 24 supports a large vacuum carriage 6 from which depend suction and blowing conduits 7 and 8, with a lateral nozzle 14 projecting back toward the spindles 4' level with the surfaces 4''. This carriage 6 contains an unillustrated blower and filter for blowing clean air out the conduit 8 toward the floor and for aspirating particle-filled air through the conduit 7 and nozzle 14 and filtering the particles out of it. It may also contain a drive motor for moving it along the rail 6. The conduits 7 and 8 depend from the carriage 6 and are not otherwise supported on the apparatus 1 so that they will not interfere with doffing and donning equipment such as shown at 5.

Figure 1:
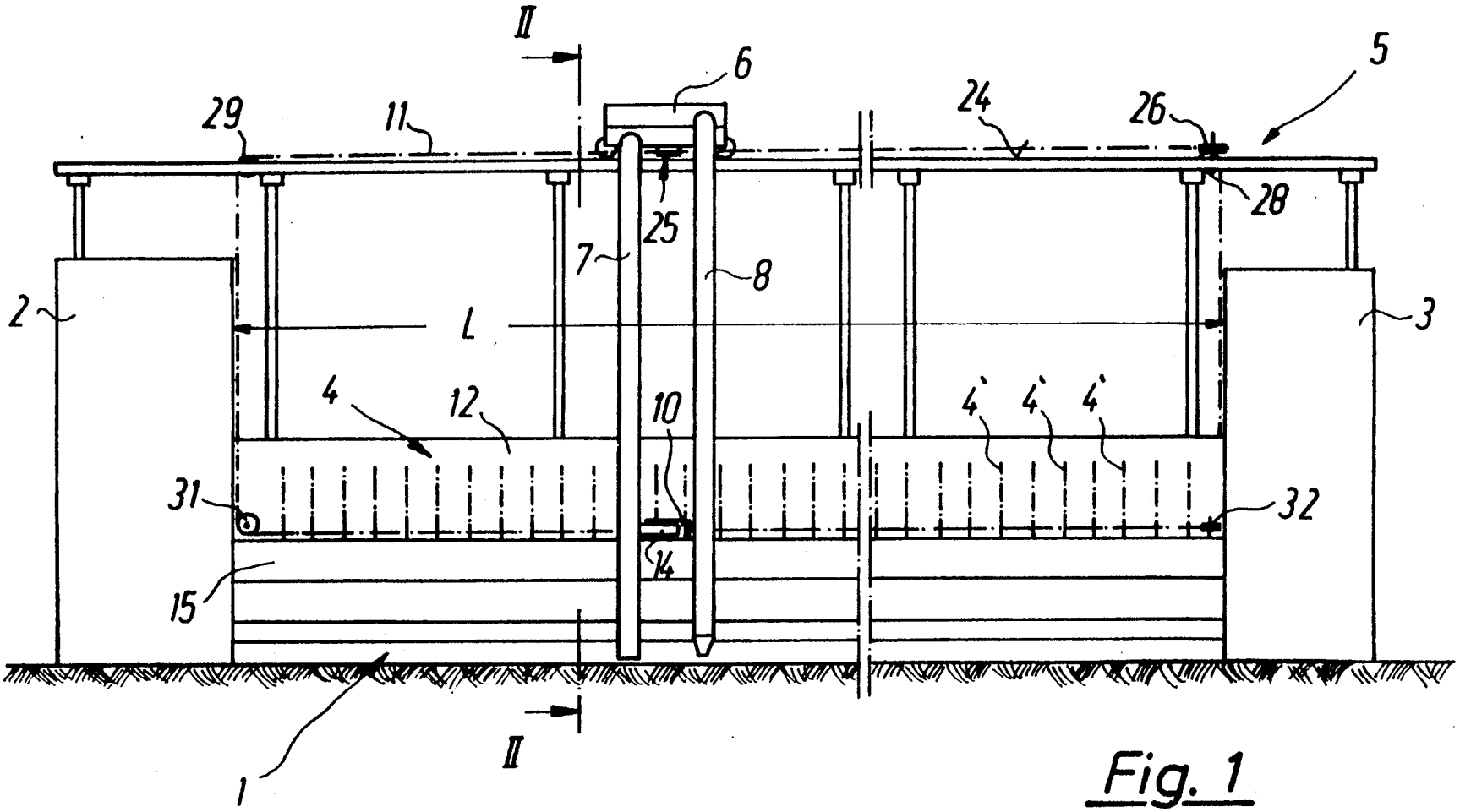
FIG. 1 is a small-scale and partly diagrammatic side view illustrating the system of this invention.
Figure 2:
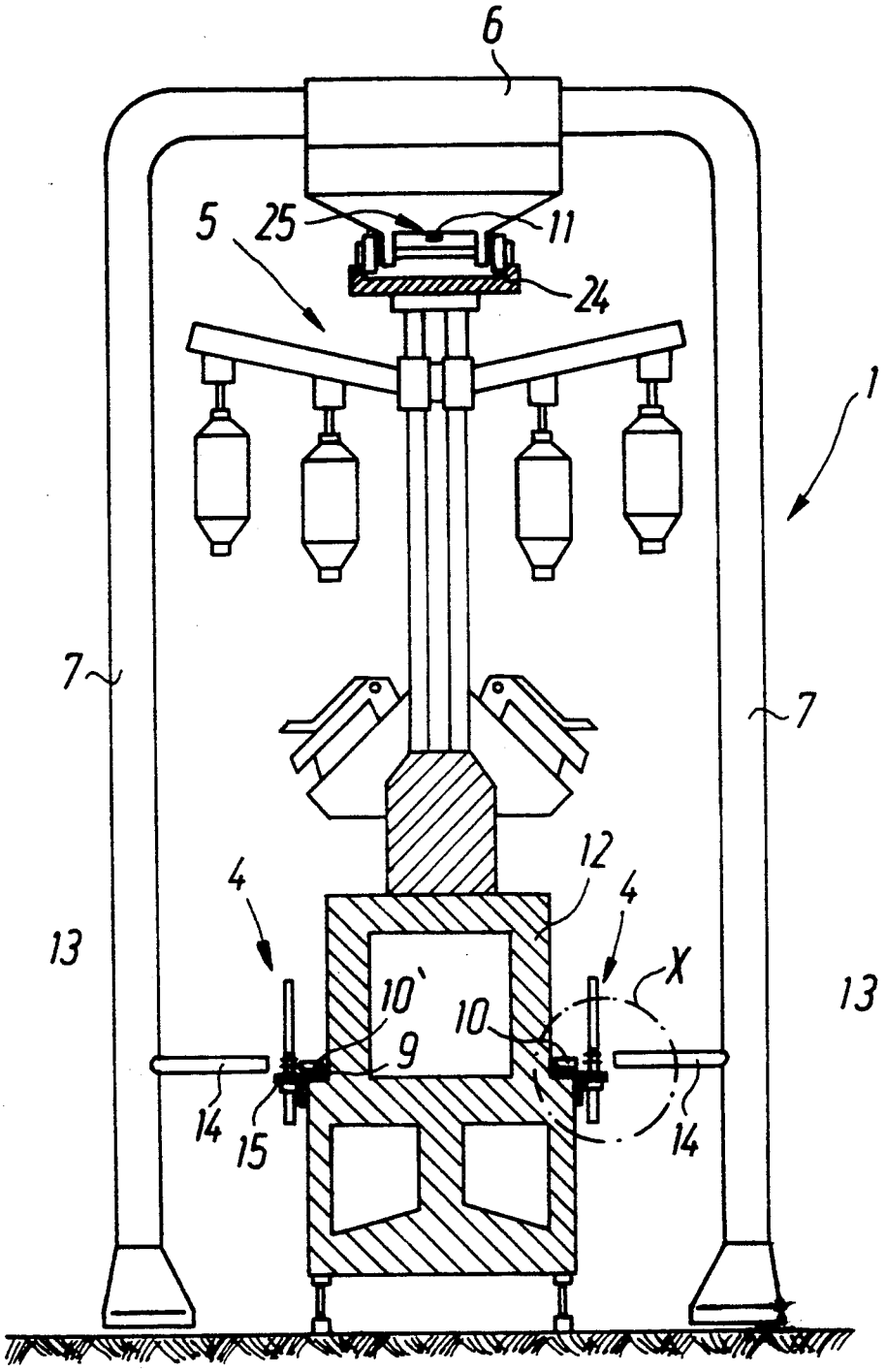
FIG. 2 is a cross section taken along line II—II of FIG. 1.
Figure 7:
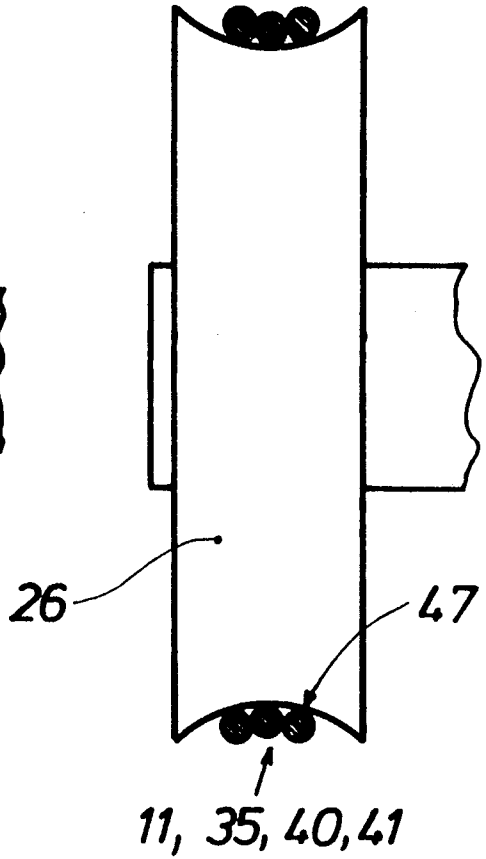
FIG. 7 is a large-scale sectional end view of a detail of FIG. 1.

In any case an endless and substantially inextensible drive cable 11 is fixed in the cleaner carriages 20, passes through an electromagnetically operable coupling 25 on the carriage 6, and is reeved over sheaves 26 through 34 located at the ends of the machine 1. The sheaves 25 are have part-circular-section grooves 47 as shown in FIG. 7 and are arranged so that a straight stretch of the cable 11 extends the full length L of the machine 1 through each of the cleaners 10 and 10'. The part-circular shape of the grooves 47 ensures a cleaning action as the cable 11 moves on the sheave. There are sufficient switchbacks in the cable 11 that the stretches connected to the cleaners 10 and 10' and to the vacuum carriage 6 will all move codirectionally and synchronously, there being one return stretch for each connected stretch.

Figure 5:
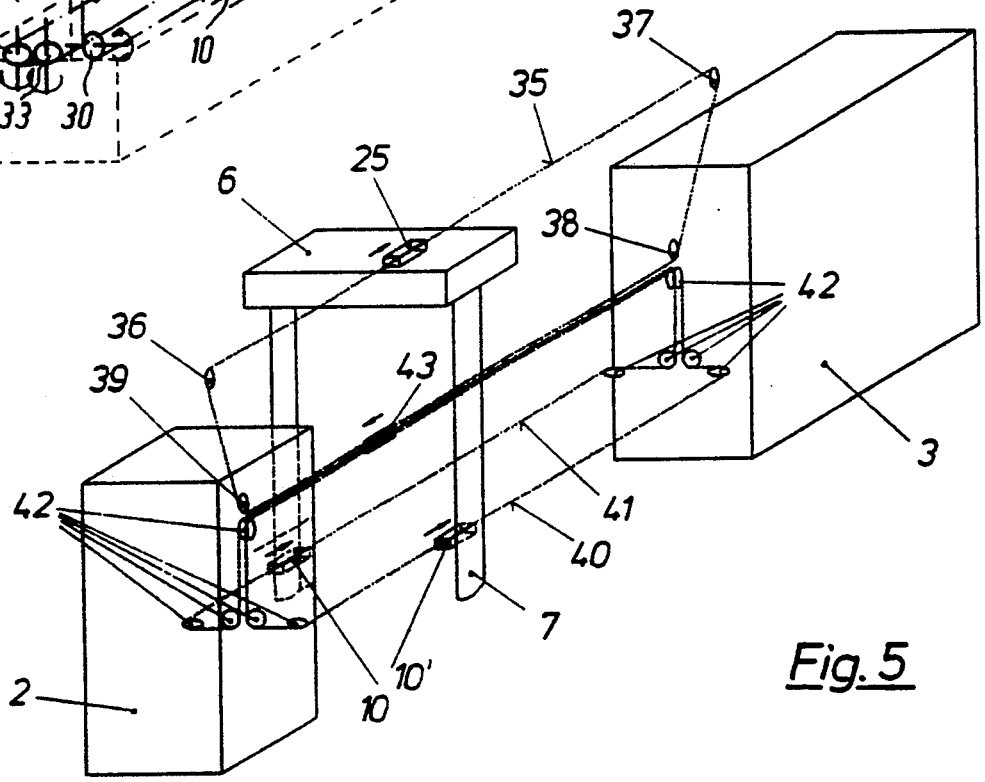
FIG. 5 is a schematic diagram illustrating another drive-element arrangement according to the invention.
Figure 6:
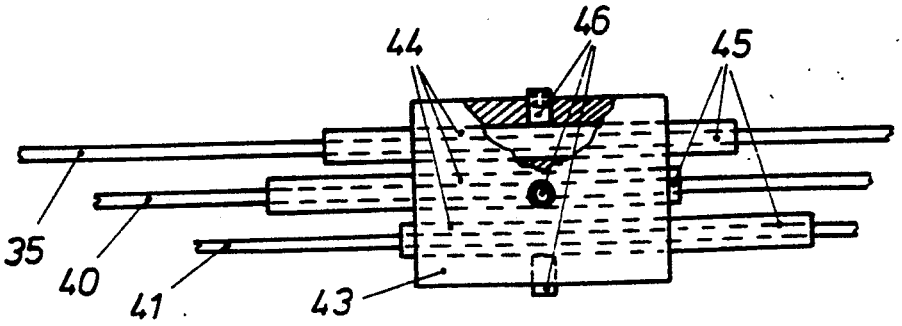
FIG. 6 is a partly sectional detail of FIG. 5.

In the arrangement of FIGS. 5 and 6 three separate cables 35, 40, and 41 are used, connected to the vacuum carriage 34, the cleaner 10', and the cleaner 10, respectively The cable 34 is spanned over wheels 36, 37, 38, and 39 in a rectangular loop. The cables 40 and 41 are spanned over wheels 42 forming loops of somewhat more complex shape. Each of the cables 34, 40, and 41 has a central stretch that lies immediately adjacent the central stretch of the other cables and a coupling or connector 43 secures them all together here. This connector 43 is formed with three parallel throughgoing bores or passages 44 through which the cables 35, 40, and 41 pass. A collet-type sleeve 45 received in each passage 44 can be clamped by a screw 46 on the respective cable 35, 40, or 41 to secure it in the coupling 43. This ensures codirectional synchronous movement of the carriage 6 with the carriages 20.

In this arrangement as long as the coupling 25 between the cable 34 and the traveling vacuum carriage 6 is open, the cables 35, 40, and 41 are all stationary even if the carriage moves. Closing the coupling 25 couples the cleaners 10 and 10' to the cleaner carriage 6.

Figure 8:
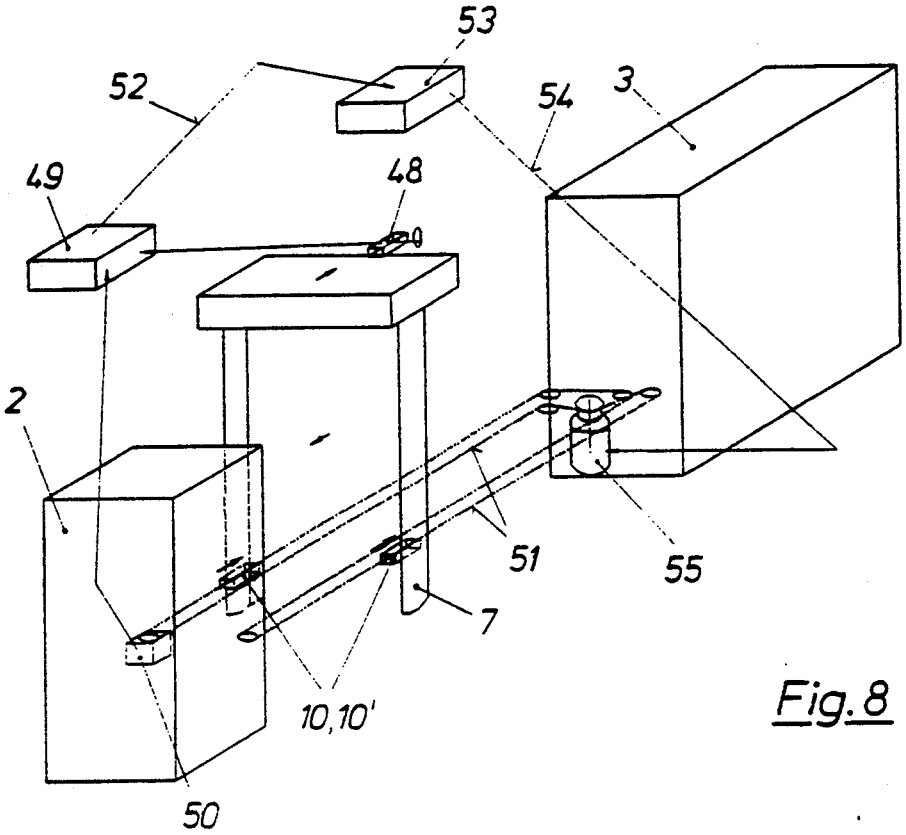
FIG. 8 is a view like FIG. 5 of another drive-element arrangement in accordance with this invention.

FIG. 8 shows an arrangement where the synchronization is done purely electrically. The vacuum carriage 6 has a position sensor 48 which feeds a position signal to a controller 49 that also receives a position signal for the two intercoupled cleaners 10 and 10' from another position sensor 50. The two cleaners 10 and 10' are carried on a common cable 51 driven by an alternating-current motor 55 operated via a line 54 from a motor controller 53 in turn operated by a line 52 from the controller 49. The speed controller 53 changes the frequency of the current it feeds to the motor 55 to ensure synchronous movement of the cleaners 10 and 10' with the vacuum carriage 6.

Figure 9:
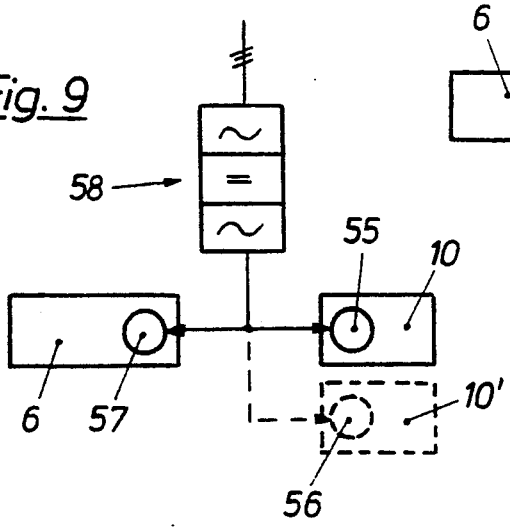
FIGS. 9 and 10 are schematic diagrams of control systems usable with the arrangement of FIG. 8.
Figure 10:
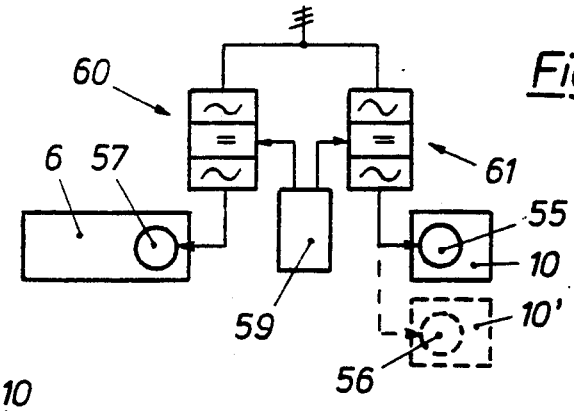

In a system with individual drive motors 55, 56, and 57 for the units 10, 10', and 6 as shown in FIG. 9 a co-on variable-frequency source 58 is used to ensure synchronous operation. This presumes of course that the motors 55, 56, and 57 are all identical and that their drive pulleys are of the same diameter. If there is a difference a system such as shown in FIG. 10 is used where a common controller 59 is connected to two variable-frequency alternating-current sources 60 and 61 connected to the respective motors 55, 56, and 57. Thus if the motors are not identical or their pulleys are of different sizes, synchronism can be maintained.

We claim:

1. In combination with a ring-spinning machine having a longitudinally extending row of spindles each adapted to hold a roving sleeve and each formed below the respective sleeve with a respective reserve winding area and a longitudinally extending frame extending along a back side of the row and a service area extending along a front side of the row, a reserve-surface cleaning system comprising:

a guide rail extending on the frame longitudinally along the back side of the row of spindles;

a cleaner carriage displaceable longitudinally along the rail past the spindles;

drive means for displacing the cleaner carriage longitudinally along the rail past the spindles;

means including a set of tools on the cleaner carriage for stripping roving from the reserve surfaces as the cleaner carriage passes same;

a vacuum carriage displaceable longitudinally along the frame;

means including a vacuum attachment fixed to the carriage and having an end projecting from the front side back toward the stations level with the reserve surfaces for aspirating roving stripped therefrom by the tools;

drive means engaged between the vacuum carriage and the frame for displacing the vacuum carriage longitudinally along the frame and thereby sequentially positioning the attachment immediately adjacent the surfaces; and synchronizing means connected between both of the drive means for synchronously jointly moving the carriages and maintaining the attachment transversely aligned with the tools.

2. The reserve-surface cleaning system defined in claim 1 wherein the synchronizing means is a mechanical coupling between the two drive means.

3. The reserve-surface cleaning system defined in claim 2 wherein the drive means include at least one longitudinally extending, flexible but substantially inextensible drive element secured to the carriages.

4. The reserve-surface cleaning system defined in claim 3 wherein the drive means includes at least one releasable coupling engaged between the drive element and one of the carriages.

5. The reserve-surface cleaning system defined in claim 4 wherein the coupling is on the vacuum carriage.

6. The reserve-surface cleaning system defined in claim 4 wherein the coupling is electromagnetically operable.

7. The reserve-surface cleaning system defined in claim 4 wherein a single such drive element is connected to both carriages.

8. The reserve-surface cleaning system defined in claim 4 wherein respective independent such drive elements are connected to the carriages.

9. The reserve-surface cleaning system defined in claim 4 wherein the element is a cable.

10. The reserve-surface cleaning system defined in claim 4 wherein the drive means each include at least one sheave having a part-circular-section groove.

11. The reserve-surface cleaning system defined in claim 1 wherein each drive means includes a respective electric drive motor, the synchronizing means including an electronic synchronizing circuit connected between the motors.

12. The reserve-surface cleaning system defined in claim 1 wherein both of the motors operate on discontinuous voltage and the synchronizing means includes at least one discontinuous-voltage generator connected to both motors.

13. The reserve-surface cleaning system defined in claim 1 wherein the carriage and vacuum drives include respective carriage and vacuum drive motors connected to the respective carriages, the synchronizing means including means including respective vacuum and cleaner sensors for generating outputs corresponding to the longitudinal positions of the respective carriages; and means connected to the motors and to the sensors for operating the motors to position the tools transversely in line with the attachment.

14. The reserve-surface cleaning system defined in claim 1 wherein the machine has a second such rows of spindles with its back sides turned toward the back sides of the first-mentioned row of spindles, the cleaning apparatus having a second such guide rail, cleaner carriage, set of tools, and cleaner-carriage drive means for the second row of spindles.

15. The reserve-surface cleaning system defined in claim 1 wherein the frame includes a longitudinally extending upper rail above the rail of the cleaner carriage, the vacuum carriage riding on the upper rail, the attachments including a depending suction conduit having a downwardly open mouth in the service area and a laterally open nozzle level with the reserve surfaces.

16. The reserve-surface cleaning system defined in claim 15 wherein the attachments include a downwardly open blower conduit longitudinally offset from the suction conduit.

17. The reserve-surface cleaning system defined in claim 15 wherein the suction conduit extends downward from the vacuum carriage in the service area.

* * * * *